US006260605B1

(12) United States Patent
Jolivet et al.

(10) Patent No.: US 6,260,605 B1
(45) Date of Patent: Jul. 17, 2001

(54) FACILITY AND METHOD FOR THE CONTINUOUS CASTING OF METALS

(75) Inventors: Jean-Marc Jolivet, Ruange les Thionville; Eric Perrin, Metz; Cosimo Salaris; Jacques Spiquel, both of Montigny les Metz; Edouard Weisseldinger, Rombas; Marc Burty, Marieulles, all of (FR)

(73) Assignee: Ugine-Savoie Imphy, Ugine (FR)

( * ) Notice: Subject to any disclaimer, the term of this patent is extended or adjusted under 35 U.S.C. 154(b) by 0 days.

(21) Appl. No.: 09/155,206

(22) PCT Filed: Apr. 3, 1997

(86) PCT No.: PCT/FR97/00596

§ 371 Date: Dec. 4, 1998

§ 102(e) Date: Dec. 4, 1998

(87) PCT Pub. No.: WO97/37795

PCT Pub. Date: Oct. 16, 1997

(30) Foreign Application Priority Data

Apr. 5, 1996 (FR) ..... 96/04303

(51) Int. Cl.[7] ..... B22D 11/049; B22D 11/117

(52) U.S. Cl. ..... 164/475; 164/415; 164/444; 164/487

(58) Field of Search ..... 164/487, 444, 164/475, 415

(56) References Cited

FOREIGN PATENT DOCUMENTS

| | | |
|---|---|---|
| 0 35 958 | 9/1981 | (EP) . |
| 0 218 85 | 4/1987 | (EP) . |
| 0 620 062 | 10/1994 | (EP) . |
| 2 000 365 | 9/1969 | (FR) . |

*Primary Examiner*—Kuang Y. Lin
(74) *Attorney, Agent, or Firm*—Nixon Peabody LLP; Thomas W. Cole

(57) ABSTRACT

The continuous casting installation includes an ingot mould the walls (1) of which are formed by cooled metal walls (2) surmounted by a hot-top element (3) made of a heat insulating material. Holes for injecting a gas under pressure, such as a slot (10), lead into the ingot mould at least at the interface between the hot-top element and the metal wall. The insulation includes means (13 to 17), connected to the said holes, for supplying a gas or a gaseous mix with a thermal expansion capacity adjustable according to the composition of the cast metal alloy and the casting conditions. The adjustment of the thermal expansion capacity of the injected gas enables the adjustment of the heat flux density extracted from the cast metal in the zone where it starts to solidify.

19 Claims, 1 Drawing Sheet

FACILITY AND METHOD FOR THE CONTINUOUS CASTING OF METALS

BACKGROUND OF THE INVENTION

1. Field of the Invention

This invention concerns the continuous casting of metals, especially steel.

2. Description of the Related Art

The continuous casting operation consists schematically, as is known, in pouring a molten metal into an ingot mould mainly consisting of a tubular element without a bottom, defining a passageway for the cast metal. The walls of the mould, made of copper or, more generally of a copper alloy, are energetically cooled by circulating water. The product already solidified externally over a thickness of several centimeters is continuously extracted from the mould. The solidification then progresses towards the centre of the product and is completed during the descent of the product downstream of the ingot mould in the so-called "secondary cooling" zone under the effect of water spray lines. The product obtained, the bloom, billets or slab, is next cut to length then rolled before being shipped to the customer or transformed in situ into bars, wires, sections, plates, sheets, etc..

Surface defects or defects under the surface of the products obtained by the continuous casting of steel often lead to scrapping as they are not well tolerated by the rolling operation or are even amplified by this operation which may go as far as intolerably degrading the metallurgical quality of the rolled products.

During casting, the molten metal, fed into the ingot mould via a nozzle, forms a solid film when it comes into contact with the cooled walls of the ingot mould. This film is driven downwards during the extraction of the product by jerky movements punctuated by the vertical oscillations of the ingot mould and, simultaneously, its thickness increases due to continued heat extraction via the walls of the ingot mould. Therefore, a new film of solid metal is continuously created at the level of the free surface of the metal in the ingot mould, this film solidifying over the complete perimeter of the inner wall of the ingot mould and thus comprising a solid ring liable to contract due to the cooling to which it is submitted during its descent in the ingot mould.

The contraction of the ring is augmented as heat extraction increases and by the natural tendency of the cast metal to contract during cooling, for example by change of solid phase at end of solidification as is the case especially for the 0.1% carbon steel or stainless steel AISI 304 grades.

This peripheral contraction tends to separate the solidified skin from the wall of the ingot mould and therefore leads to a reduction in the heat exchange as the contact of the said skin with the cold walls is degraded. This separation is generally unequal over the perimeter of the solidified skin and is a source of surface defects in the product finally obtained.

To avoid or limit these defects, a specific technique not yet industrialised, known as vertical continuous casting, consists in placing a hot-top element made of a heat-insulating refractory material above the cooled metal walls of the ingot mould and in maintaining, during casting, the free surface of the metal bath at the level of the said hot-top element (French patent No. 2000365). Thus, the molten metal does not solidify in contact with the hot-top element, the first solidified skin starting to form only from the upper edges of the cooled metal wall. As these edges are located at a sufficient distance below the disturbed zone near to the free surface, the creation and the growth of the solid skin is achieved continuously always at same level in the ingot mould, in a calm environment from a hydrodynamic viewpoint, in the region where the ferrostatic pressure exerted by the weight of the liquid metal located above opposes the tendency of the first solidified skin to separate from the cold wall of the ingot mould.

In this technique, an improvement, known by document EP-A-O 620 062, consists in injecting, into the ingot mould, at the level of the said hot-top element and at least just at the interface between the said hot-top element and the cooled metal walls, an inert gas under pressure. This gas injection, made via a thin annular slot made between the said walls and the hot-top element, forms jets perpendicular to the walls and directed towards the liquid metal which shear any solidified skins which may have formed in contact with the refractory hot-top element in order to ensure that solidification effectively starts exactly at the upper edge of the cooled walls.

Although this technique in principle enables the appearance of certain surface defects on the finished product to be reduced, it does not however solve the problems concerning the adaptation of the casting process to the various families of steel grades which can be continuously cast to take into account the specificities of each of the grades concerning their thermomechanical behaviour during solidification.

SUMMARY OF THE INVENTION

The aim of this invention is to solve these problems and more especially to enable, in the vertical continuous casting technique, control and easy adaptation of the heat flux extraction conditions especially in the zone where solidification starts.

With these targets in mind, the subject of the invention is a continuous metal casting process where an ingot mould including energetically cooled metal walls surmounted by a hot-top element made of a heat insulating material is used and, during casting, the free surface of the molten metal contained in the ingot mould is kept at the level of the said hot-top element, and a gas under pressure is injected around the complete periphery of the ingot mould at the level of the said hot-top element and at least at the interface between this hot-top element and the cooled walls. According to the invention, this process is characterised in that the said injected gas is a gas or a gaseous mix having an adjustable thermal expansion capacity to adjust, according to the composition of the cast metal alloy and the casting conditions, the density of the heat flux, which is extracted from the said metal alloy in the zone where it starts to solidify, to a predetermined value specific to the cast alloy.

Thus, the process according to the invention offers the possibility of easily adapting, according to needs, the heat flux density extracted from the cast metal to the level where the solidified skin forms, in particular to the composition of the said metal, especially the grade for casting steels.

Indeed, the inventors observed during casting tests made by injecting an inert gas, such as argon or helium, at the interface between the hot-top element and the cooled metal walls, that the heat flux density was strongly influenced by the thermal expansion capacity of the gas. Thus, for the casting of a 0.8% carbon steel in an ingot mould the cooled walls of which were made of an uncoated copper alloy and with a casting speed of 1.5 m/min, the extracted heat flux density over the first 40 millimeters from the upper edge of the metal walls was around 5 $MW/m^2$ when the temperature of the injected argon was around 500° C., and was only 4.2 or even 3.2 $MW/m^2$ when the temperature of the injected argon was around 100° C. During another test conducted with an ingot mould where the upper faces of the cooled walls were covered with a 1.5 mm layer of nickel, for casting a 0.09% carbon steel, and with a casting speed of 2 m/min, the extracted heat flux was 5.5 $MW/m^2$ for an injected argon temperature of 500° C., and only 3.5 $MW/m^2$ for an argon temperature of 100° C.

These high differences in the extracted heat flux value could not be explained by the sole influence of the temperature of the gas on the cast metal which has a temperature of around 1600° C. in the upper section of the ingot mould. A hypothesis put forward by the inventors is that this difference results, on the one hand, from the stirring effect of the liquid steel caused by the injected gas in the direct vicinity of the upper edge of the cooled metal walls, where solidification initiates and, on the other hand, and in a predominant manner, by the influence of the gas bubbles formed directly at the outlet of the injection holes. Concerning this influence, it can be considered that the said bubbles have, just before entering the liquid steel, a size which is more or less uniform, determined by the dimensions of the injection holes, and this irrespective of the temperature of the injected gas. When these bubbles reach the molten steel, their temperature is almost instantaneously increased to the temperature of the steel. The result is an increase in the volume in the bubbles by the expansion of the gas of which they are formed. The expansion in the volume of the bubbles augments as the variation in temperature increases. The result is that, once the bubbles reach the temperature of the molten steel, their size will increase as the temperature of the injected gas is lowered. In other words, the lower the temperature of the injected gas is relative to the temperature of the molten steel, the greater the expansion of the gas, and the larger the resulting bubbles of the gas will be. Now, larger bubbles which form just at the outlet of the injection holes, and therefore just at the level of the upper edge of the cooled walls, will in a way prevent the liquid steel from coming directly into contact with the upper edge of these walls and therefore greatly reduce the heat flux extracted by these walls whereas smaller bubbles will prevent direct contact to a lesser extent and therefore will only slightly reduce the extracted heat flux. Because the gas is injected at the point on the walls where a majority of the heat flux from the steel to the walls occurs, it can be seen that bubbles of increased size will provide greater insulation between the molten steel and the cooled walls, decreasing the heat flux. Therefore, decreasing the temperature of the injected gas results in increased bubble volume, and a corresponding increase in insulation of the molten metal from the cooled walls, and thereby a decreasing heat flux. Because of this fact, even in an arrangement using an injected gas that comprises only a single component, the flux may be adjusted by adjusting the gas temperature.

According to a first variant, to adjust the thermal expansion capacity of the injected gas, the temperature of the said gas is therefore controlled.

According to a specific arrangement of the invention, the temperature of the injected gas is adjustable between 50 and 600° C., this adjustment range enabling the temperature of the gas to be fixed at a predetermined value so that the extracted heat flux density is between 2.5 and 6 $MW/m^2$, thus providing wide adaptation possibilities according to the composition of the cast metal alloy and various other casting parameters.

Preferably, the temperature of the gas is adjusted by mixing in a determined volumetric ratio the gas from a hot source at a more or less constant temperature, for example 700° C., with a gas from a cold source also at a more or less constant temperature, for example 20° C. The total flow rate of the injected gas is the sum of the flow rates of the gases obtained from the two sources respectively. The ratio between these two flow rates enables the temperature of the injected gas to be varied whilst conserving a more or less constant total flow rate. In practice, by taking the inevitable heat losses into account and with the temperatures of the two sources mentioned above, it is possible to vary the temperature of the injected gas between 50 and 600° C.

According to a specific arrangement, especially enabling the heat losses to be reduced as far as possible, the gas mix is made in a mixing chamber located in the walls of the ingot mould and/or in the hot-top element, the temperature of the injected gas being adjusted by adjusting the flow rates of the gases from the hot and cold sources respectively and introduced into the said chamber.

According to another variant, the injected gas is a mix of at least two gases comprising the mix, for example argon and helium, the heat expansion capacity of which is adjusted by adjusting the relative proportions of the said component gases. In this variant, the fact that the component gases of the mix have different physical properties, in particular different densities, is used to adjust, according to their relative proportions, the density of the mix. In a manner similar to the effect, described above, of the influence of the temperature difference between the injected gas and that of the steel on the expansion of the volume of the bubbles when they come into contact with the molten steel, the different physical properties of the injected gases, such as the thermal diffusivity and, especially, the density, influence, for a given difference between the temperature of the injected gas and that of the molten steel, the expansion of the bubbles of the said gases. For an argon and helium mix, it can be seen that the density of the helium is around ten times lower than that of the argon. The result is that when the bubbles of these two gases are submitted to a same temperature increase, the expansion in their volumes is very different. It is therefore understandable that the effect of the expansion of the bubbles of a mix of these gases, injected at a more or less similar temperature, varies according to their proportions in the mix and it is sufficient to adjust this proportion to adjust the heat flux intensity extracted from the cast steel by the cooled walls of the ingot mould.

The subject of the invention is also a continuous metal casting installation including an ingot mould the walls of which are formed of cooled metal walls surmounted by a hot-top element made of a heat insulating material, and injection holes leading into the ingot mould to inject into the ingot mould a gas under pressure in the form of jets distributed around the periphery of the ingot mould at the level of the hot-top element and at least at the interface between the said hot-top element and the metal wall characterised in that it includes supply means for the said gas, connected to the said holes, enabling the thermal expansion capacity of the injected gas to be adjusted.

The said gas supply means can include injected gas temperature control means, or means for controlling the relative proportions of at least two component gases of a gaseous mix forming the injected gas.

Preferably, in order to be able to easily adjust the temperature of the injected gas or the proportion of the gases comprising the injected mix, the casting installation includes two gas sources connected to a mixing chamber, itself connected to the said holes, and means for adjusting the flow rates of the gases delivered by the said sources respectively and introduced into the mixing chamber.

According to one arrangement, the mixing chamber is located outside the ingot mould and connected to a distribution channel made in the wall of the ingot mould.

According to another arrangement, the mixing chamber is located within the wall of the ingot mould. In this case, especially suitable for the adjustment of the temperature of the injected gas, the mixing chamber can especially consist of a first distribution chamber made in the hot-top element and connected to the hot gas source and a second distribution chamber made in the metal walls and connected to the cold source.

To facilitate the design, the mixing chamber or the distribution channel can also be made completely within the cooled metal walls. In this case, in order to reduce the cooling of the gas to a minimum when it passes into the said mixing chamber or the said channel, the walls of the latter can be coated with a heat insulating material.

Other characteristics and advantages will appear in the description which will be given as an example of two design variants of a hot top vertical continuous steel casting installation in compliance with the invention.

BRIEF DESCRIPTION OF THE DRAWINGS

Refer to the appended drawings on which.

DETAILED DESCRIPTION OF THE INVENTION

Figure 1:
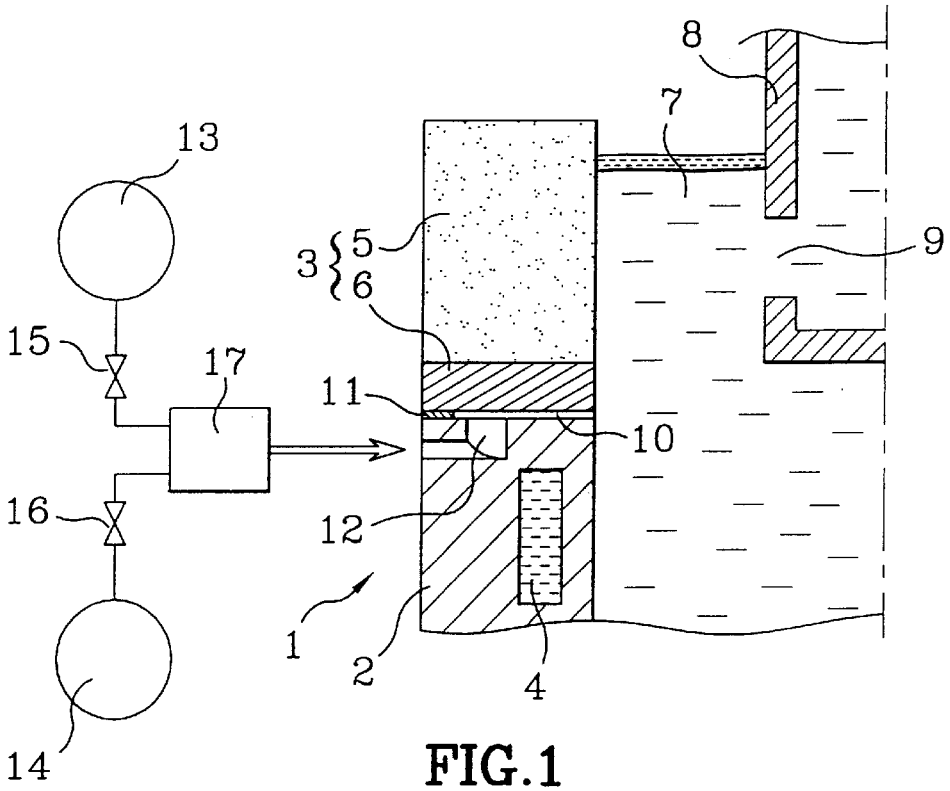
FIG. 1 is a schematic representation of a first variant, showing a partial longitudinal cross-sectional view of the upper part of the ingot mould.

The walls 1 of the ingot mould shown on FIG. 1 at consist of metal walls 2, made of copper or a copper alloy, surmounted by a hot-top element 3 made of a refractory heat insulating material. The metal walls 2 are energetically cooled by internal water circulation in channels 4, schematically represented on the figure. The hot-top element 3 consists of an upper section 5, with a height of 200 mm for example, made of a very insulating material and a lower section 6 made of a refractory material possibly with lower insulating properties but with better strength, for example the material known as SiAlON and for example with a thickness of 20 mm.

The walls 1 of the ingot mould define a passageway for the cast product, into which the molten steel 7 is conventionally fed by a nozzle 8 including openings 9 located at the height of the said hot-top element 3.

The ingot mould also includes gas injection holes, leading to the inner surface of the walls 1, at the interface between the hot-top element 3 and the metal wall 2, preferably in the form of a continuous slot around the periphery of the ingot mould thus ensuring uniform injection of the gas around the complete periphery.

This narrow slot 10 is around several tenths of a millimeter high, for example 0.2 mm, set by a spacer 11 inserted between the lower section 6 of the hot-top element and the metal wall 2, on wall outer side. The slot 10 leads to the inner surface of the walls of the ingot mould around the complete periphery of the ingot mould.

A distribution channel 12 is made in the metal wall 2 in the form of a groove made in the upper face of the said metal wall and communicating with the slot 10 around the complete periphery of the ingot mould.

The casting installation also includes a hot source 13 of an inert gas, for example argon, heated to a temperature of around 700° C. by heating means, known themselves, and a cold source 14 of the same gas, held at ambient temperature, for example 20° C. These two gas sources are connected by conduits equipped with adjustment valves 15, 16 to a mixing chamber 17 itself connected to the distribution channel 12.

During casting, the gas under pressure from the mixing chamber 17 is distributed into channel 12 and is injected into the ingot mould via the slot 10. The temperature of the gas thus injected can be adjusted by means of the valves 15 and 16 by acting on the ratio of the flow rates of the gases from each source respectively.

The distribution channel 12 can also be made in the refractory hot-top element 3, which offers the advantage of limiting the heat losses of the gas due to the high temperature, around 800° C., of the said hot-top element. It is however easier to machine the distribution channel in the metal wall 2, and, in this case, to limit the cooling of the gas in contact with the metal of the wall, the temperature of which is only around 100° C., the walls of the said channel can be coated with an insulating material, such as zirconia or boron nitride.

Figure 2:
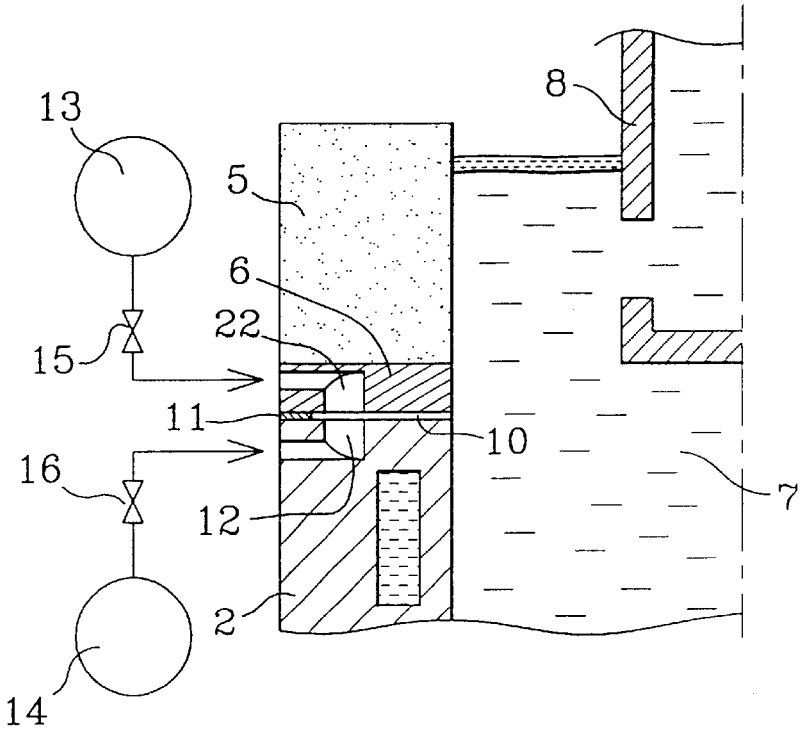
FIG. 2 shows a second design variant.

In the design variant shown on FIG. 2, in addition to the groove 12 made in the metal wall 2, a second groove 22 is made in the lower section 6 of the hot-top element, opposite the groove 12 and also communicating with the slot 10. The hot gas source 13 is connected, via the valve 15, directly to this groove 22, and the cold source 14 is connected via the valve 16 to the groove 12. The volume defined by these two grooves comprises both a distribution chamber and a mixing chamber located entirely within the wall 1 of the ingot mould.

The invention is not limited to the variants described above only as an example and, in particular, the temperature of the injected gas may be adjusted by means other than the mixing of the hot and cold gases described above.

If an argon and helium mix is used and the proportions adjusted, an installation such as the one shown on FIG. 1 could be used for example by replacing the hot source 13 and the cold source 14 respectively by the argon and helium sources, the adjustment valves 15 and 16 then enabling the adjustment of the respective flow rates of these two gases which are mixed in chamber 17.

What is claimed is:

1. A continuous metal casting process for use with an ingot mould including energetically cooled metal walls surmounted by a hot-top element comprising the steps of: maintaining a free surface of a molten metal contained in the ingot mould at a level so that the free surface is insulated by said hot-top element; injecting a gas around a complete periphery of the ingot mould proximate to said cooled walls; and adjusting the heat flux density from said metal to said cooled walls by controlling a thermal expansion capacity of said injected gas based on at least one of desired composition of metal cast and a casting condition; said thermal expansion capacity of said gas being defined by temperature of said injected gas.

2. The process in accordance with claim 1, wherein the temperature of the injected gas is in a range between 50 and 600° C.

3. The process in accordance with claim 1, wherein the injected gas includes an inert gas.

4. The process in accordance with claim 1, wherein said injected gas is a mixed gas including at least a first and a second gas, wherein said step of adjusting the thermal expansion capacity of said injected mixed gas is attained by mixing said first gas and said second gas in a defined volumetric ratio.

5. The process in accordance with claim 1, wherein the thermal expansion capacity of said gas is adjusted so that said heat flux density is in a range between 2.5 and 6 MW/m2.

6. The process in accordance with claim 4, wherein said first gas and said second gas are mixed in a mixing chamber integrally formed in at least one of said ingot mould and said hot-top element, the temperature of said first gas being substantially greater than the temperature of said second gas.

7. A continuous metal casting process for use with an ingot mould including energetically cooled metal walls surmounted by a hot-top element comprising the steps of: maintaining a free surface of a molten metal contained in the ingot mould at a level so that the free surface is insulated by said hot-top element; injecting a gas around a complete periphery of the ingot mould proximate to said cooled walls; and adjusting the heat flux density from said metal to said cooled walls by adjusting a thermal expansion capacity of said injected gas; said thermal expansion capacity of said gas being defined by temperature of said injected gas;

wherein the thermal expansion capacity of said gas is adjusted so that said heat flux density is in a range between 2.5 and 6 MW/m2.

8. A continuous metal casting process for use with an ingot mould including energetically cooled metal walls surmounted by a hot-top comprising the steps of: maintaining the free surface of the molten metal contained in the ingot at such a level as to be effectively insulated by said hot-top element; injecting a mixed gas that includes at least a first gas and a second gas distinct from said first gas around a complete periphery of the ingot mould proximate to said cooled walls; adjusting the heat flux density from said metal to said cooled walls by controlling the thermal expansion capacity of said injected mixed gas based on at least one of desired composition of metal cast and a casting condition; said thermal expansion capacity of said injected mixed gas being defined by the relative proportions of said first gas and said second gas.

9. The process in accordance with claim 8, wherein said injected gas includes argon and helium.

10. A continuous metal casting process for use with an ingot mould including energetically cooled metal walls surmounted by a hot-top element comprising the steps of: maintaining a free surface of a molten metal contained in the ingot mould at a level so that the free surface is insulated by said hot-top element; injecting a gas around a complete periphery of the ingot mould proximate to said cooled walls; and adjusting the heat flux density from said metal to said cooled walls by adjusting a thermal expansion capacity of said injected gas; said thermal expansion capacity of said gas being defined by temperature of said injected gas;

wherein said injected gas is a mixed gas including at least a first and a second gas, wherein said step of adjusting the thermal expansion capacity of said injected mixed gas is attained by mixing said first gas and said second gas in a defined volumetric ratio;

wherein said first gas and said second gas are mixed in a mixing chamber integrally formed in at least one of said ingot mould and said hot-top element, the temperature of said first gas being substantially greater than the temperature of said second gas.

11. The process in accordance with claim 10, wherein said first gas is provided by a hot source and said second gas is provided by a cold source, said volumetric ratio of said first gas and said second gas being adjustable by an adjustment means.

12. An apparatus for continuous metal casting comprising an ingot mould with energetically cooled metal walls defining a passage for casting metal, said cooled metal walls being adapted to begin solidification of liquid metal proximate to said cooled metal walls, the thickness of at least partially solidified liquid metal increasing as the liquid metal traverses through said passage; a hot-top element surmounting said cooled metal walls; injection holes in the form of jets distributed around a periphery of the ingot mould proximate to an interface between said hot-top element and said metal walls; and a supply means connected to said holes for supplying a gas to said injection holes; an adjusting means for controlling thermal expansion capacity of the injected gas by adjusting the temperature of said gas based on at least one of desired composition of metal cast and a casting condition.

13. The apparatus in accordance with claim 12, wherein said supply means includes at least two gas sources connected to a mixing chamber that is connected to said injection holes, and further includes an adjusting means for adjusting the flow rates of the gases delivered respectively by said at least two gas sources.

14. The apparatus in accordance with claim 13, wherein the mixing chamber is located outside of the ingot mould and connected to a distribution channel in the metal walls of the ingot mould.

15. The apparatus in accordance with claim 13, wherein the mixing chamber is at least partially located within the walls of the ingot mould.

16. The apparatus in accordance with claim 15, wherein the mixing chamber includes a first distribution chamber in the hot-top element and connected to a hot gas source and a second distribution chamber in the metal walls and connected to a cold gas source.

17. The apparatus in accordance with claim 15, wherein walls of said mixing chamber are coated with a heat insulating material.

18. An apparatus for continuous metal casting comprising an ingot mould with energetically cooled metal walls defining a passage for casting metal, said cooled metal walls being adapted to begin solidification of liquid metal proximate to said cooled metal walls, the thickness of at least partially solidified liquid metal increasing as the liquid metal traverses through said passage; a hot-top element surmounting said cooled metal walls; injection holes in the form of jets distributed around a periphery of the ingot mould proximate to an interface between said hot-top element and said metal walls; a supply means connected to said holes for supplying a gas that includes at least a first gas and a second gas distinct from said first gas; an adjusting means for controlling thermal expansion capacity of the injected gas by adjusting the relative proportion of said first and second gases based on at least one of desired composition of metal cast and a casting condition.

19. The apparatus in accordance with claim 18, wherein said supply means includes at least two gas sources connected to a mixing chamber that is connected to said injection holes, and further includes an adjusting means for adjusting the flow rates of the gases delivered respectively by said at least two gas sources.

* * * * *

UNITED STATES PATENT AND TRADEMARK OFFICE

CERTIFICATE OF CORRECTION

PATENT NO. : 6,260,605 B1 
DATED : July 17, 2001
INVENTOR(S) : Jean-Marc Jolivet, Cosimo Salaris, Edouard Weisseldinger, Eric Perrin, Jacques Spiquel and Marc Burty It is certified that error appears in the above-identified patent and that said Letters Patent is hereby corrected as shown below:

Title page,
Item [73], Assignee, should read: -- Ugine-Savoie Imphy, Ugine (FR); Sogepass, Amneville (FR); Sollac, Puteaux (FR), Ascometal, Puteaux (FR) --

Signed and Sealed this

Third Day of December, 2002

JAMES E. ROGAN
*Director of the United States Patent and Trademark Office*

UNITED STATES PATENT AND TRADEMARK OFFICE

CERTIFICATE OF CORRECTION

PATENT NO. : 6,260,605 B1 
DATED : July 17, 2001
INVENTOR(S) : Jean-Marc Jolivet et al.

It is certified that error appears in the above-identified patent and that said Letters Patent is hereby corrected as shown below:

Title page,
Item [75], should read -- Ugine-Savoie Imphy, Ugine (FR); Sogepass, Amneville (FR); Sollac, Puteaux (FR), Ascometal, Puteaux (FR), Société Anonyme des Forges et Aciéries de Dilling, Dilling/Sarre (FR). --

Signed and Sealed this

Nineteenth Day of August, 2003

JAMES E. ROGAN
*Director of the United States Patent and Trademark Office*